US005611735A

United States Patent [19]

Jackson

[11] Patent Number: 5,611,735

[45] Date of Patent: Mar. 18, 1997

[54] BOWLING BALL SHOT STABILIZER FOR WRIST AND FINGER

[76] Inventor: Richard W. Jackson, R.R. 1, Box 63, Derby, Iowa 50068

[21] Appl. No.: 554,339

[22] Filed: Nov. 6, 1995

[51] Int. Cl.[6] ..... A63B 69/00; A61F 5/04

[52] U.S. Cl. ..... 473/60; 473/61; 473/62; 473/127; 2/161.1; 2/162; 602/16; 602/21

[58] Field of Search ..... 473/59, 60, 61, 473/62, 63, 127; 482/44, 45, 46, 47, 49, 50; 2/16, 20, 159, 160, 161.1, 162, 163, 170; 602/5, 16, 21, 22

[56] References Cited

U.S. PATENT DOCUMENTS

| | | |
|---|---|---|
| 1,333,792 | 3/1920 | Bunnell . |
| 2,994,533 | 8/1961 | Pupilla, Jr. . |
| 3,038,723 | 6/1962 | Bergendorf . |
| 3,235,258 | 2/1966 | Stroburg . |
| 3,238,939 | 3/1966 | Stubbs . |
| 3,328,029 | 6/1967 | Paige . |
| 3,467,379 | 9/1969 | Kistner . |
| 3,606,342 | 9/1971 | Albertson, Jr. . |
| 3,704,994 | 12/1972 | Krzewinski et al. . |
| 3,829,090 | 8/1974 | Ensinger . |
| 4,176,840 | 12/1979 | Lanning . |
| 4,332,382 | 6/1982 | Smith . |
| 4,371,163 | 2/1983 | Shaffer et al. . |
| 4,441,490 | 4/1984 | Nirschl . |
| 4,441,711 | 4/1984 | Dubar et al. . |
| 4,479,648 | 10/1984 | Alivo, Jr. . |
| 4,531,735 | 7/1985 | Kovacs . |
| 4,552,359 | 11/1985 | McDonald . |
| 4,608,720 | 9/1986 | Purin . |
| 4,666,158 | 5/1987 | Moro . |
| 4,677,971 | 7/1987 | Lindeman . |
| 4,925,187 | 5/1990 | Fleenor et al. . |
| 5,014,689 | 5/1991 | Meunchen et al. . |
| 5,163,678 | 11/1992 | Rogers . |
| 5,330,391 | 7/1994 | Mitchell . |
| 5,466,192 | 11/1995 | Castolo et al. ..... 473/61 |

FOREIGN PATENT DOCUMENTS

| | | |
|---|---|---|
| 336025 | 2/1904 | France . |

*Primary Examiner*—William M. Pierce
*Attorney, Agent, or Firm*—Henderson & Sturm

[57] ABSTRACT

A bowling apparatus including a first support adapted to cover at least a portion of at least one finger of a bowler; a second support adapted to cover at least a wrist of a hand of a bowler; and an adjustable support comprising one end connected to the first support and another end pivotally connected to the second support.

8 Claims, 7 Drawing Sheets

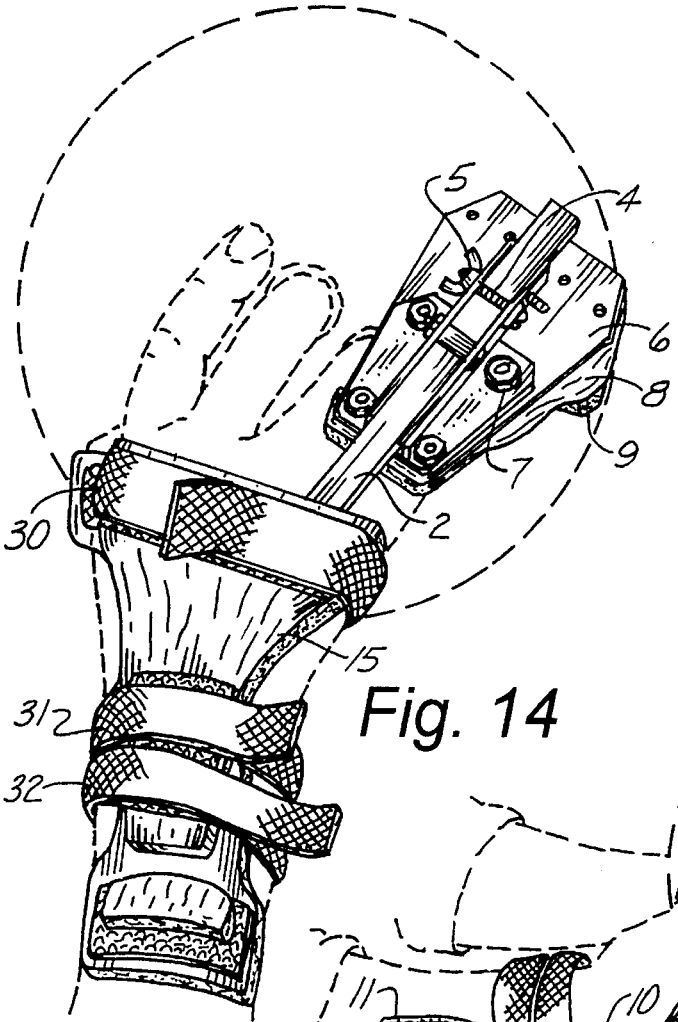
Fig. 14
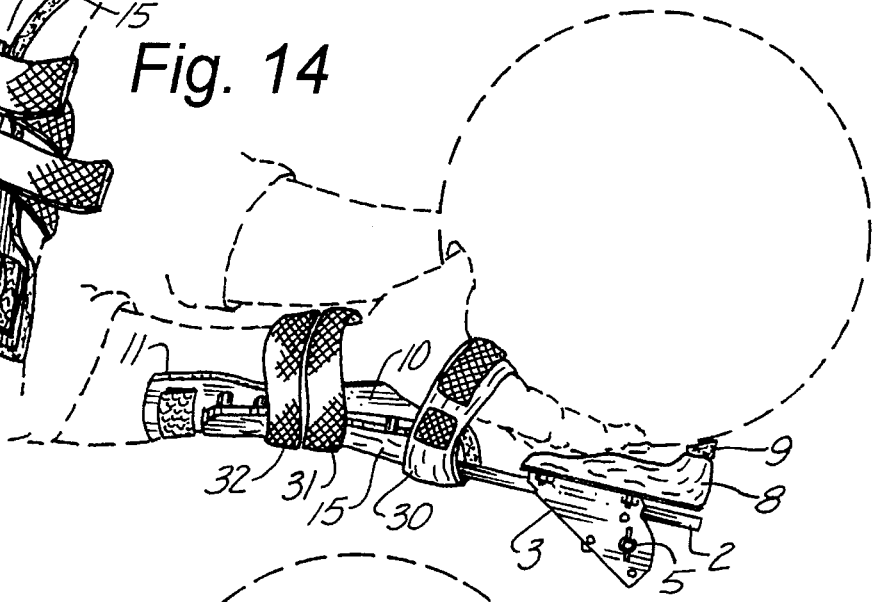
Fig. 15
Fig. 16
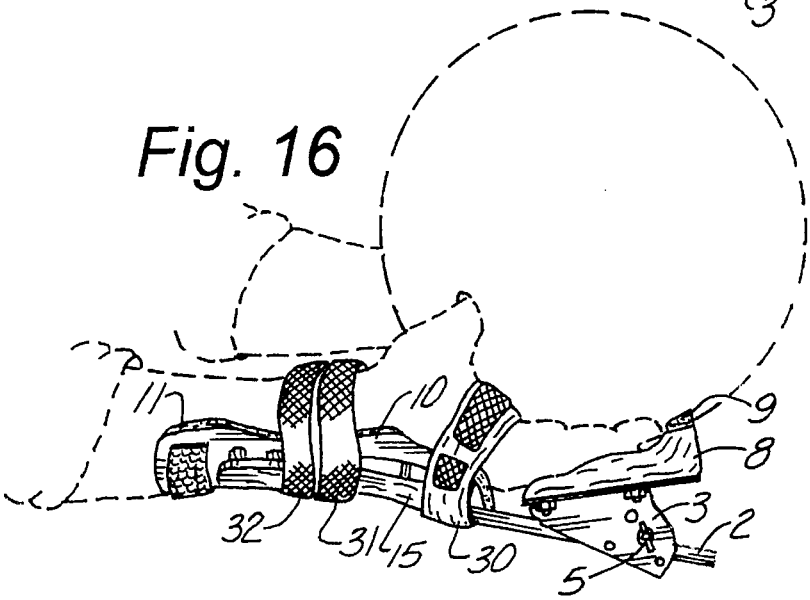

BOWLING BALL SHOT STABILIZER FOR WRIST AND FINGER

FIELD OF THE INVENTION

The present invention relates to apparatus for supporting the wrist, hand, and fingers of a user. More specifically, the present invention relates to an apparatus for supporting the wrist, hand, and fingers of a user in a desired, predetermined position. The present invention is directed to an apparatus for supporting the wrist, hand and fingers of a bowler in a desired, predetermined position which assists the bowler in imparting controlled velocity, speed, spin, and roll to the bowling ball. The present invention is also directed to an apparatus for supporting the wrist, hand and fingers of either hand of a bowler which is adapted to be worn on substantially any-sized hand. The present invention is also directed to an apparatus for supporting the wrist, hand, and fingers of a bowler in a desired, predetermined position so as to minimize or reduce stress and strain on joints, ligaments, and tendons of the bowler which may otherwise occur if the wrist, hand, and fingers of the bowler were not supported by such an apparatus.

DISCUSSION OF BACKGROUND AND MATERIAL INFORMATION

In bowling-type sports, particularly ten-pin bowling, it is important to impart desired roll to the bowling ball.

The present invention is directed to an apparatus which supports the wrist, hand, and fingers of the bowler to enable the bowler to better maintain control over the bowling ball, to deliver the ball with higher velocity, and in a more controlled manner.

An important aspect of being able to control the roll and spin of the ball is the strength of the delivery and the ability to impart more power in the strike zone. In this regard there are a number of factors that contribute to scoring well. One of these involves a firm hand position during delivery, in particular during the time of release.

In an attempt to enhance and improve the delivery of bowling balls by the bowler, a number of hand and/or wrist and/or finger control and/or support devices have been developed. Representative examples of such devices include those described and shown in, for example U.S. Pat. Nos.: 1,333,792, 2,994,533, 3,038,723, 3,235,258, 3,238,939, 3,238,029, 3,467,379, 3,606,319, 3,606,342, 3,704,994, 3,829,090, 4,176,840, 4,332,382, 4,371,163, 4,441,490, 4,441,711, 4,479,648, 4,531,735, 4,552,359, 4,608,720, 4,666,158, 4,677,971, 4,925,187, 5,014,689, 5,163,678, 5,330,391.

Such support devices range in function and design from what would be referred to as a glove to what would merely be a support to minimize certain movement of the wrist, hand, or finger.

Such prior art devices have been found to suffer from a number of disadvantages including the fact that, for example, a glove covers the entire hand of a bowler. Also some prior art devices may hinge or bend only at the wrist. Some of such prior art devices are designed so that the support provided to the wrist, hand, and/or finger normally ends at the knuckles on the hand. Some other of such devices provide primarily support substantially only to the wrist.

Although some prior art devices have been designed to impart a predetermined type of roll to the bowling ball, such prior art devices are not adjustable in a manner which allows the bowler to impart, or aids the bowler in imparting, different rolls and/or spins on the ball during the course of the event. Specifically, such prior art devices are not adjustable in a manner which affects the power imparted by the fingers of the hand of the bowler.

Moreover, prior art devices typically are not effective in minimizing and/or reducing the stress and strain often experienced at the finger, wrist, and hand of the bowler.

SUMMARY OF THE INVENTION

The present invention is directed to an apparatus for supporting the wrist, hand, and fingers of a user, such as a bowler, in desired, predetermined positions.

The apparatus for supporting the wrist, hand, and fingers of a user of the present invention is particularly advantageous in providing such support in a manner which reduces and/or minimizes stress and strain that may otherwise be experienced by the user, and which assists a bowler in imparting a controlled amount of roll and/or spin to the ball.

The apparatus for supporting the wrist, hand and fingers of the bowler in accordance with the present invention is advantageous over prior art devices in that, among other things, it leaves the bulk of the hand substantially uncovered thereby permitting better feel of the ball.

These and other objects and advantages of the present invention will become more apparent from the following detailed description when taken in conjunction with the accompanying drawings.

BRIEF DESCRIPTION OF DRAWING

FIG. 14 is a another perspective view of the support apparatus of the present invention in position on the arm of a user, positioned so as to expose the middle two fingers of the wearer and to contact the ball in a way to impart a desired degree of spin, wherein the pinky finger and ring finger are covered by a portion of the apparatus in accordance with the present invention.

FIG. 15 is a side elevational view of the apparatus for support in accordance with the present invention strapped to the wrist of a user disclosing the relationship of the bowling ball relative to the palm, wrist and forearm of the user.

FIG. 16 is a another side elevational view of the apparatus for support in accordance with the present invention strapped to the wrist of a user disclosing the relationship of the bowling ball relative to the palm, wrist and forearm of the user.

DETAILED DESCRIPTION

The present invention intended to be claimed is disclosed and illustrated herein.

Figure 1:
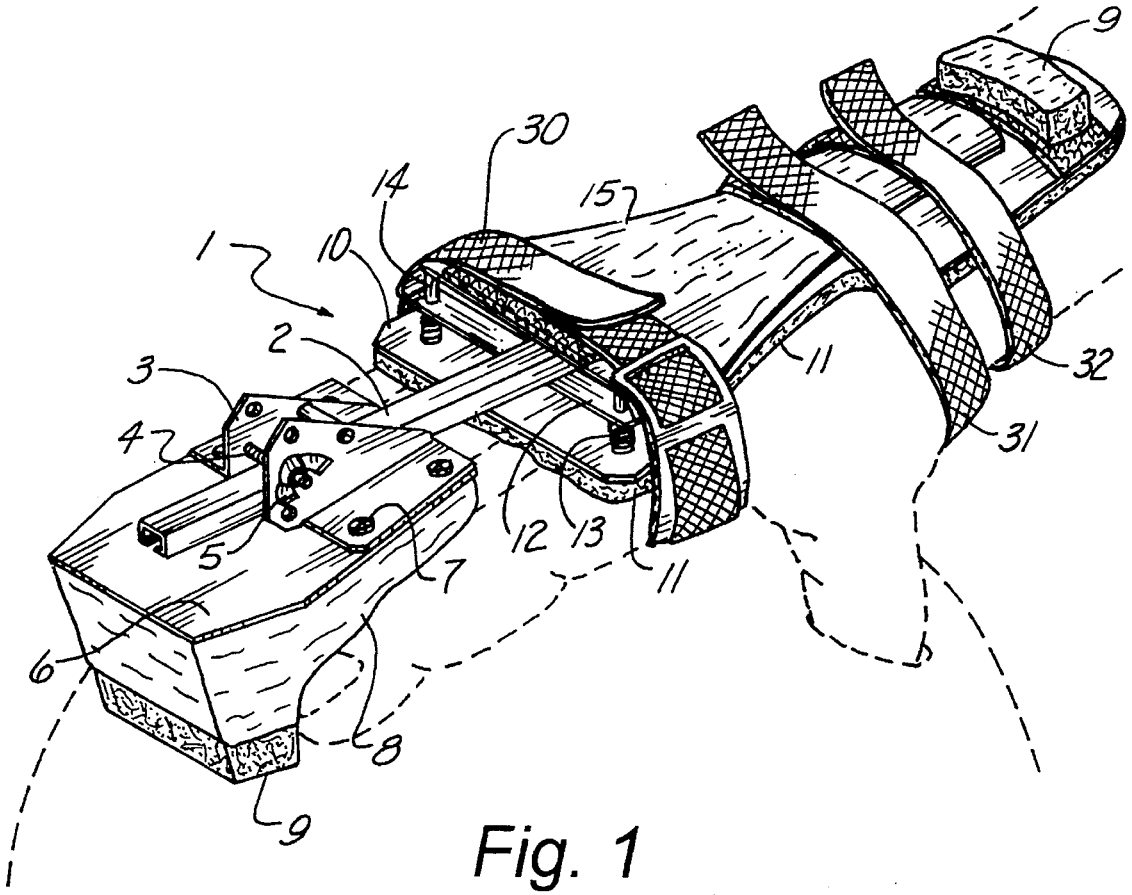
FIG. 1 is a perspective view of the apparatus of the present invention showing the position of the lower arm, wrist, back of hand, and fingers of a user.
Figure 2:
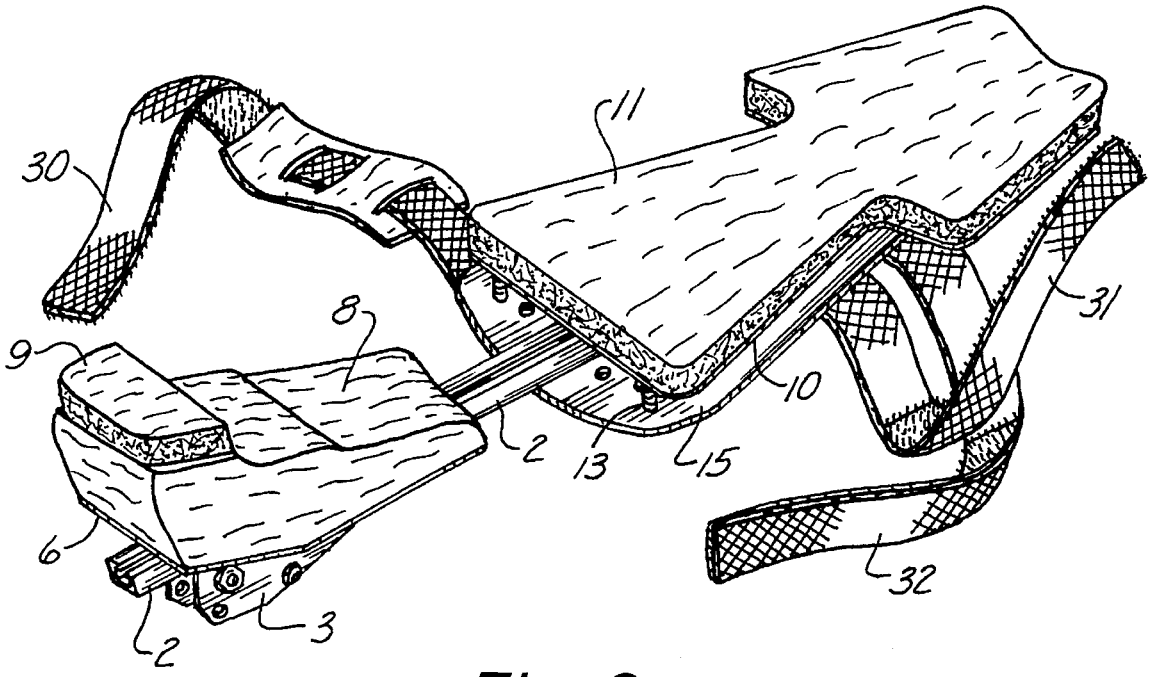
FIG. 2 is a perspective view of the apparatus otherwise shown in FIG. 1 from the underside.

More specifically, the apparatus of the present invention is generally shown in the drawings as element 1. Referring to the drawings, the apparatus of the present invention, also referred to herein as "support" or "ball shot stabilizer", includes an adjustable support 2 which may be in the form of a shaft, beam, or similar elongate element, to which other elements of the apparatus in accordance with the present invention may be attached. The adjustable support 2 may be composed of suitable structural material selected from a group consisting of metal, metal alloys, composites, plastics, and the like having sufficient structural rigidity and other characteristics so as to give it sufficient strength for the intended usage. Attached to the adjustable support 2 in an adjustable manner is power setting bracket 3, which also may be constructed of similar materials to those used for the adjustable support 2. As shown, for example in FIG. 1, adjustments can be made between the adjustable support 2 and power setting bracket 3, via set screw 4 that is tightened in position through screw holes by wing nut 5. A second set screw 24 and nut 35 may also be provided where different settings are desired.

As discussed in herein, the ball pad 9 and finger pad 8 can be set in multiple positions, and preferably three positions, for finger and roll power desired, by making appropriate adjustments of the power setting bracket 3 and adjustable support 2.

A support plate 6, also referred to as a forward support plate 6, is attached to power setting bracket 3 by suitable fastening means 7 which may be selected from a group consisting of screws, nuts, bolts, rivets or the like. Adhesives may also be used for this purpose. Alternatively, the support plate 6 and power setting bracket 3 may be integral, or constructed as a one-piece unitary unit.

Attached to support plate 6 by suitable means, preferably adhesives or the like, is a pad 8. The pad 8 is designed so to provide support to the upper portion of the fingers of the user, including the knuckles and the tips of the fingers, and is also referred to herein as finger pad 8. The pad 8 may contact the hand of the bowler directly or form a base for other pads that directly contact the hand of the bowlers. Particularly in the latter case, the pad 8 extends forward of the tips of the fingers to provide a base for a ball pad 9. As shown and described herein, the pad 8 is shown as having a unitary construction which contacts different parts of the fingers and hand. However, the pad 8 may be constructed from a plurality of pads each of which is designed to contact a separate portion of the finger, for example, the knuckles, and the tips of the fingers, while yet another pad is designed to be attached to the support plate 6 as a base for ball pad 9.

The apparatus of the present invention also includes a second or rearward support plate 10 positioned rearwardly of the forward support plate 6 and to which is attached a pad 11 by means of adhesive or similar means for attachment as used to attach pad 8 to support plate 6. In this regard, suitable means for attachment include members selected from a group consisting of screws, nuts, bolts, rivets or the like. The pad 11 is designed to contact the back of the hand of the user. Preferably, the support plate 10 is mounted with respect to shaft 2 in a biased manner, for example, by the cooperation of spring-biased plate 12 and springs 13 biased to move along screws or rods 14. The rods 14 are connected to an upper support plate 15 which is maintained spaced apart from support plate 10 by spacers 16.

The adjustable support 2 is fitted into housing 17 which in turn is secured by suitable means to upper plate 15, for example by screws, bolts, rivets, adhesive, or other suitable means for securing to support plate 10.

The housing 17 is adjustably positioned with respect to upper support plate 15 by a detent 20 which is configured to fit into each of a plurality of orifices 21 provided in upper support plate 15. The orifices 21 are provided in a suitable configuration to permit adjustable support shaft 2 to be secured or locked into position. In this regard, the adjustable support shaft 2 may be adjusted in a position defined by one of a plurality of angles formed with respect to a longitudinal axis of the apparatus of the present invention. Preferably, upper support plate 15 should be provided with at least 3 and up to about 7 orifices 21 for this purpose. However, a greater or lesser number of orifices 21 may be provided so long as sufficient space is available for them.

The orifices 21 are shown as holes through support plate 15. However, indentations, depressions or other cavities may alternatively be provided in support plate 15 if suitable to cooperate with detent 20 to secure the relative positions of housing 17 and upper support plate 15. Related to this, detent 20 may be in the form of a plug, lug or other proturbence or catch which would effectively function in the previously described manner.

The previously described structure of the apparatus of the present invention is maintained in position on the hand of a bowler by means of straps 30, 31, and 32. Although three straps are shown, more or less than three straps could be used. For example, two straps could be suitable for purposes of the present invention. The width of the straps are preferably relatively narrow. However, if a single wrist strap is used its width would be substantially half of the length of the support plate.

In this regard, strap 30, also referred to as palm strap 30, is attached at one end by suitable means, for example adhesive, but preferably by means of a hook and loop fastener, such as a Velcro®, to the upper support plate 15. The palm strap 3 is designed to have sufficient length so as to loop around and the palm of the hand and permit its free end to attach to suitable means for attachment, such as a hook and loop fastener at the other secured end. Alternatively, other means for attachment, such as buckles, buttons, snaps, or other compression fitting devices could be used for this purpose so long as the apparatus of the present invention is comfortably fastened to the hand of the wearer. Straps 31 and 32, also referred to as wrist straps 31 and 32, are similarly attached to support plate 15 for wrapping around the wrist portion of the hand of the bowler. Although two such wrist straps are shown, at least one wrist strap could be suitable for purposes of the present invention, and more than two wrist straps are also envisioned.

The straps 30, 31, and 32 are preferably made of fabric, such as web material, selected from the group consisting of natural materials, synthetic materials, and blends of natural synthetic materials. Cotton is a preferred natural material. Nylon and polyesters are preferred synthetic materials. However, natural leather may also be used.

Figure 3:
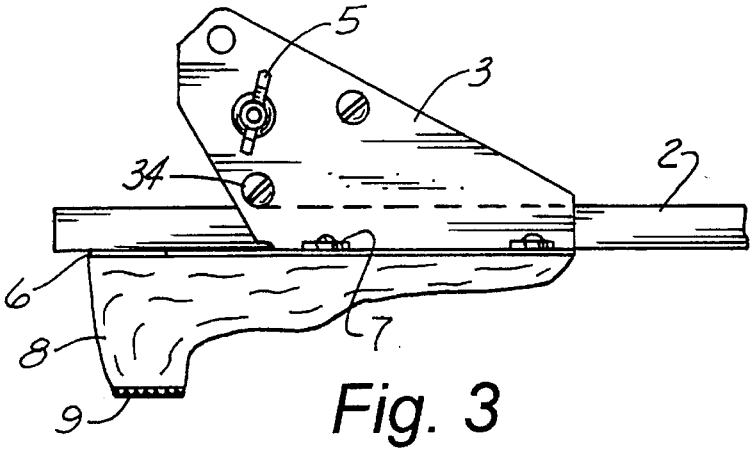
FIG. 3 is a side elevational view of the apparatus of the present invention.
Figure 6:
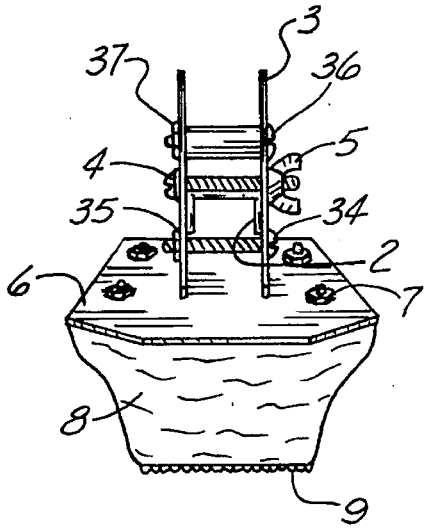
FIG. 6 is a front view of the apparatus of the present invention, shown in FIG. 4.
Figure 4:
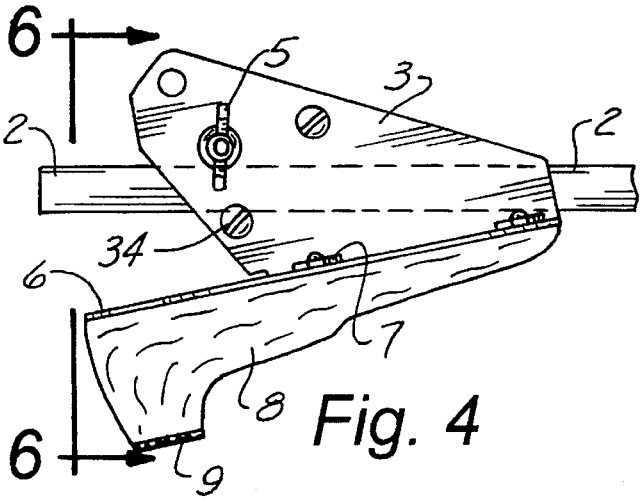
FIG. 4 is a side elevational view of the apparatus of the present invention which has been adjusted to a position different from that shown in FIG. 3.
Figure 5:
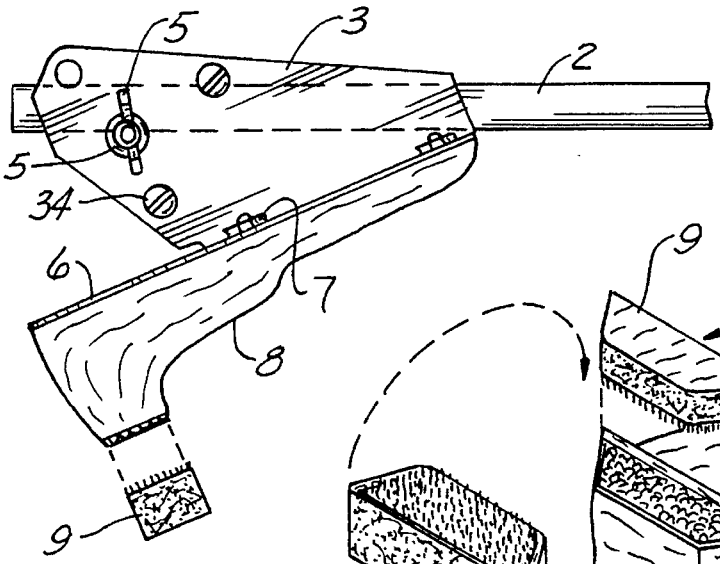
FIG. 5 is another side elevational view of the apparatus of the present invention, adjusted to a yet different position, provided with an attachment element.
Figure 7:
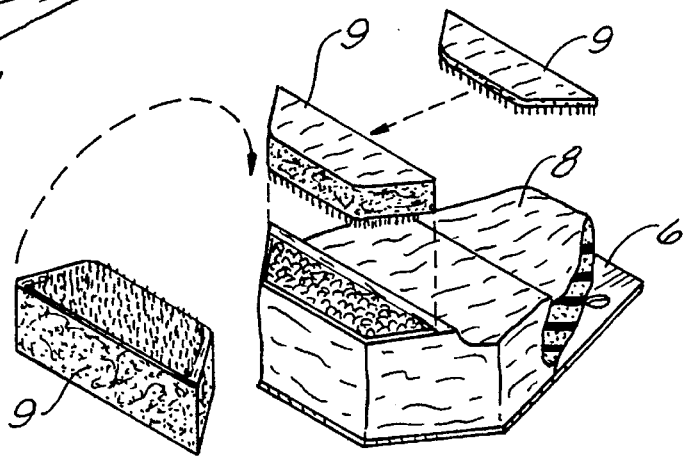
FIG. 7 is an exploded perspective of the front pad element of the apparatus in accordance with the present invention showing the attachment element otherwise depicted in FIG. 5.
Figure 8:
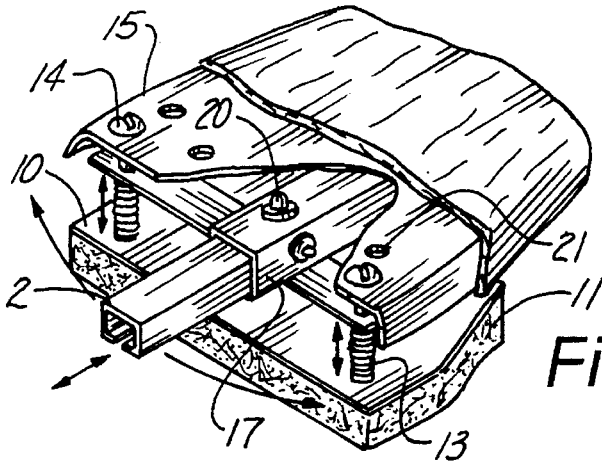
FIG. 8 is a perspective view of the portion of the wrist support element of the support apparatus of the present invention.
Figure 9:
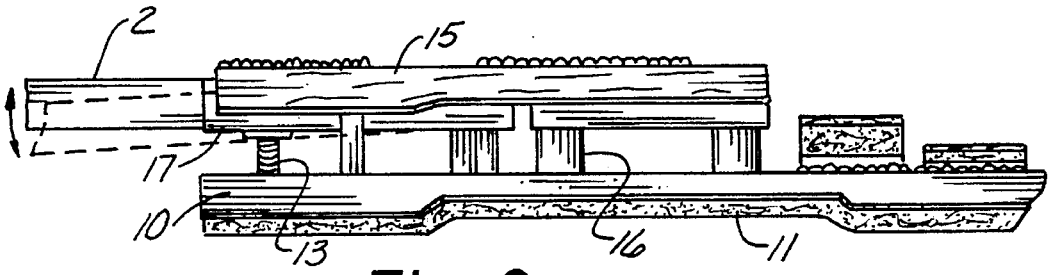
FIG. 9 is a side elevational view of the apparatus of the present invention.
Figure 10:
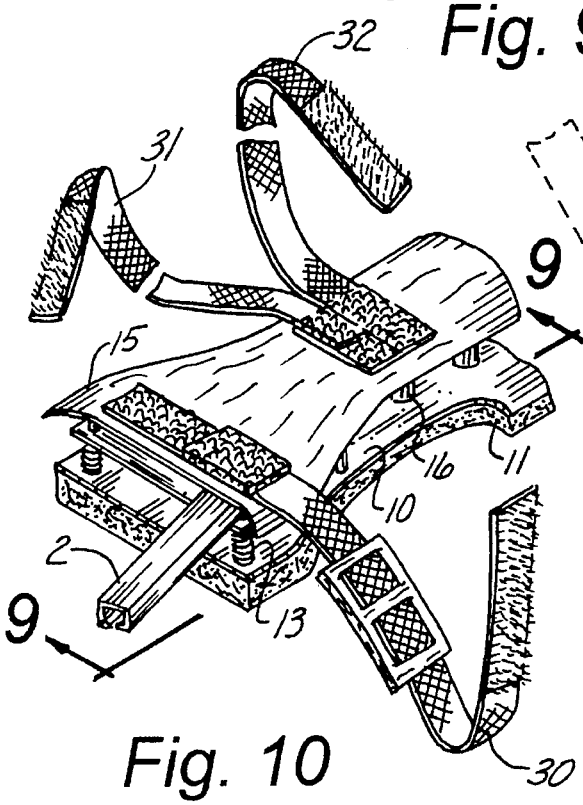
FIG. 10 is a perspective view of the wrist support section of the apparatus of the present invention showing an adjustable guide, and adjustable means for attaching the apparatus of the present invention to the wearer.

As shown in FIGS. 3, 4, and 5, power setting bracket 3 permits the forward support plate 6 to be adjusted in multiple positions. In this regard, the bracket 3 may be adjusted in position to a plurality of alternative positions. Preferably, the pad may be adjusted in three positions. to this end, in addition to set screw 4 and wing nut 5, a second set screw 24 and adjustable nut 35 is provided, as shown in FIG. 3. Related to this, FIG. 3 shows a first position wherein the apparatus is aligned in a substantially horizontal plane due to the fact that adjustable support 2 is placed adjacent to support plate 6 and abuts set screw 34, the front support plate is set at an angled position relative to the plane of adjustable support 2 which is fitted between set screw 4 and set screw 34. FIG. 5 shows yet a third position adjustment wherein the adjustable support 2 is positioned between set screw 4 and set screw 36, shown more clearly in FIG. 6. Accordingly, the ball and finger pad can be set in at least three positions in order to facilitate the finger and roll power.

Figure 11:
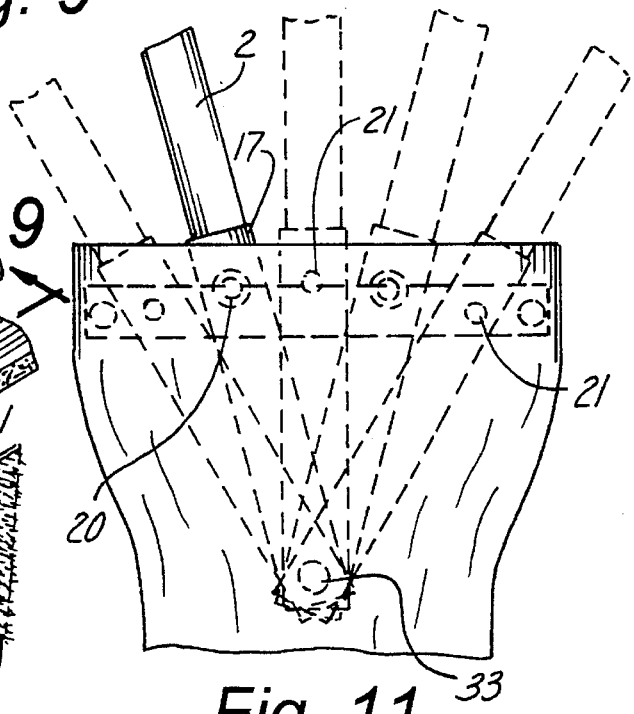
FIG. 11 is a top view showing a selected number of adjustable positions for the guide member of the support apparatus in accordance with the present invention.

As shown in FIG. 11, a journal 33, also referred to as a swivel pin, is provided towards the rearward end of adjustable support 2 and functions as a pivot for angular adjustment of the adjustable support 2 and the effect thereof as described herein.

Figure 12:
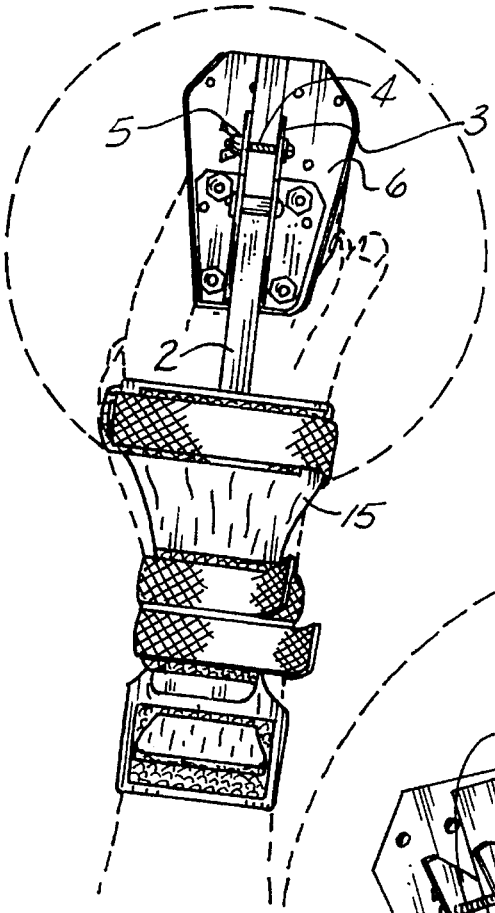
FIG. 12 is a perspective view of the apparatus in accordance with the present invention in position on the arm of a user, showing one support position covering the two middle fingers of the hand.

Referring to FIG. 12, the apparatus of the present invention is positioned on the arm of a user in one support position wherein the forward support plate 3 covers the two middle fingers of the hand.

Figure 13:
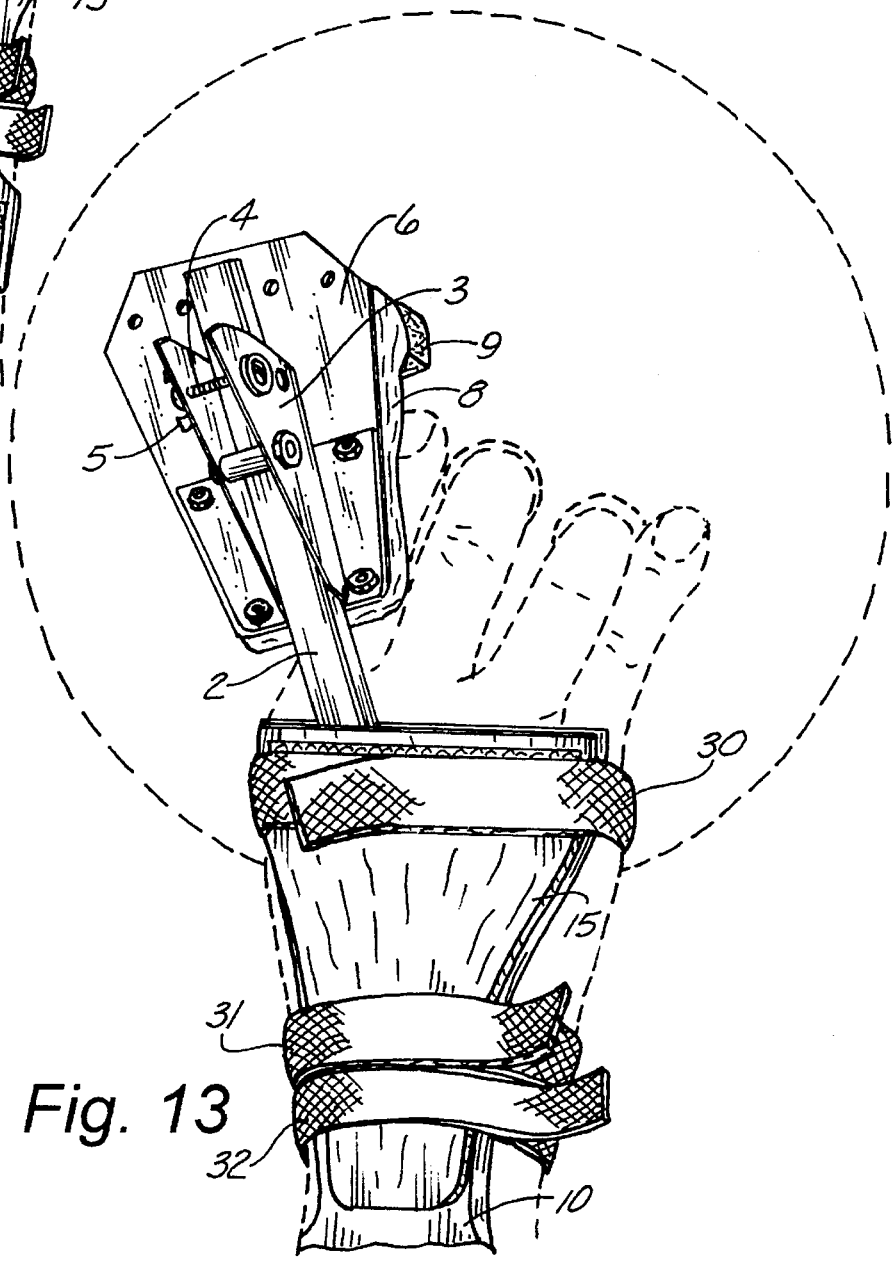
FIG. 13 is a another perspective view of the support apparatus of the present invention in position on the arm of a user, so as to expose the middle two fingers of the wearer and to contact the ball in a way to impart a desired degree of spin.
Figure 17:
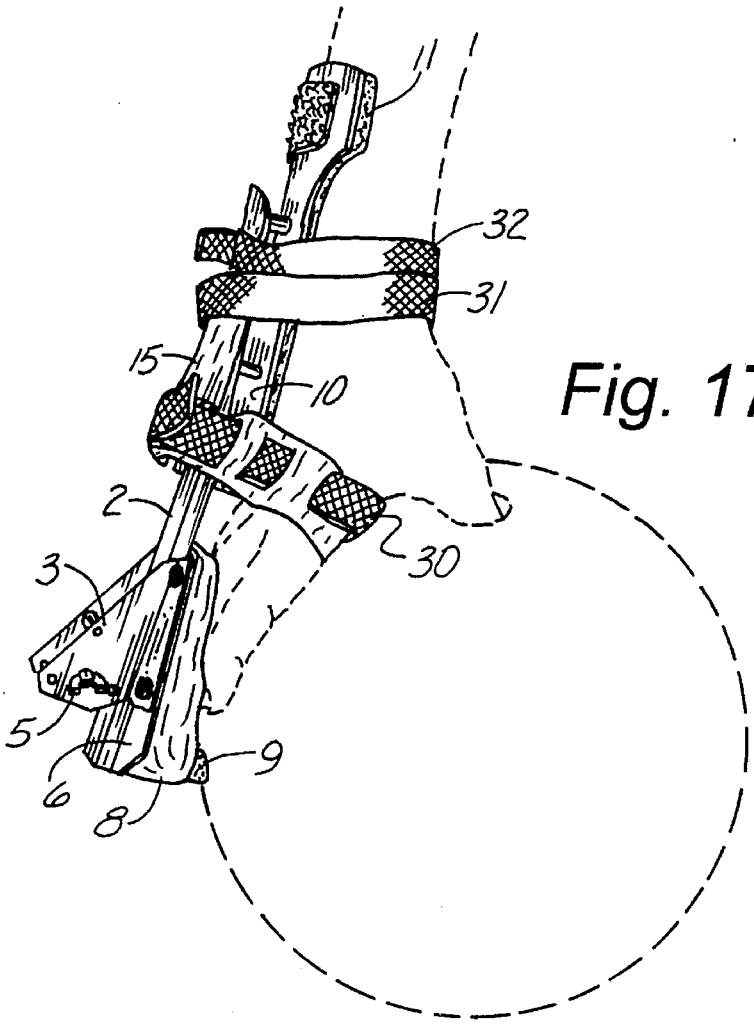
FIG. 17 is yet another side elevational view of the apparatus for support in accordance with the present invention strapped to the wrist of a user disclosing the relationship of the bowling ball relative to the palm, wrist and forearm of the user.
Figure 18:
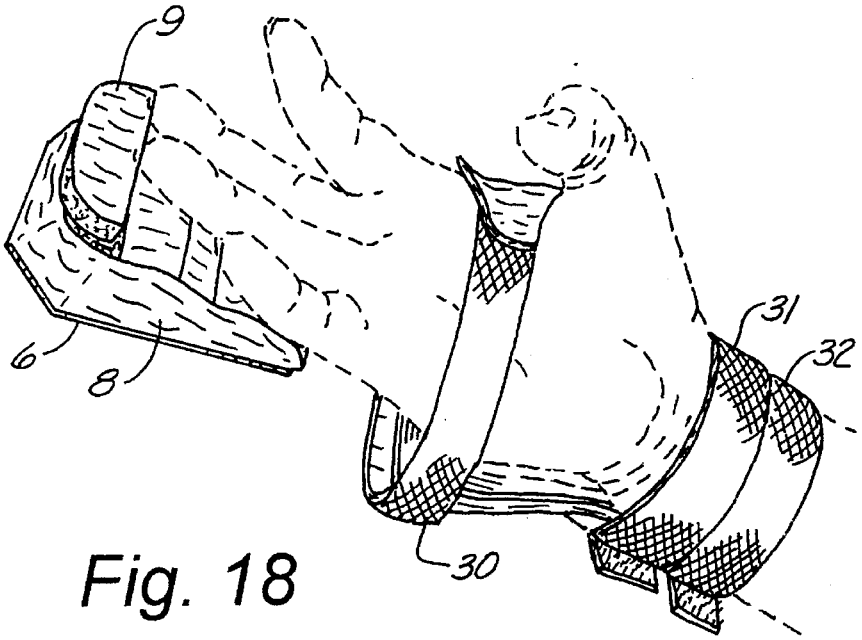
FIG. 18 is a bottom elevational view of the support in accordance with the present invention strapped to the wrist of the user showing the relationship of the hand relative to the apparatus of the present invention.
Figure 19:
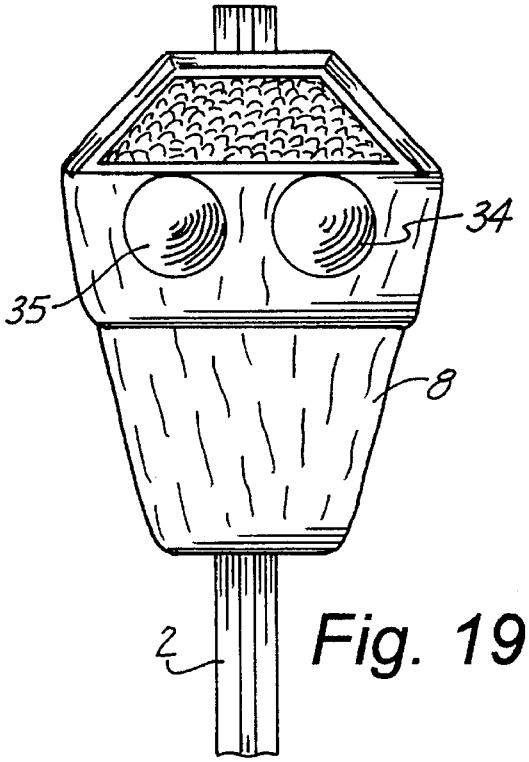
FIG. 19 is a plan view of the bottom of another embodiment of the support in accordance with the present invention provided with artificial fingers.
Figure 21:
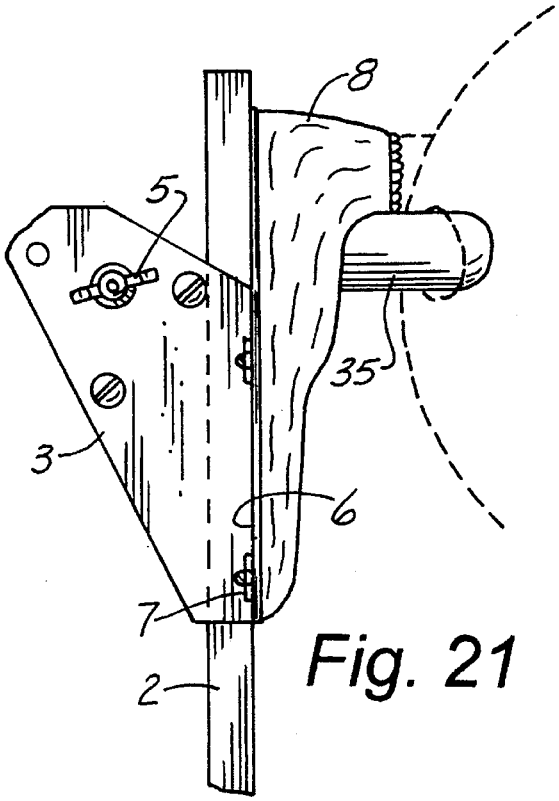
FIG. 21 is a side perspective view showing the relationship of the embodiment of the support, shown in FIG. 19 in relationship to a bowling ball.
Figure 20:
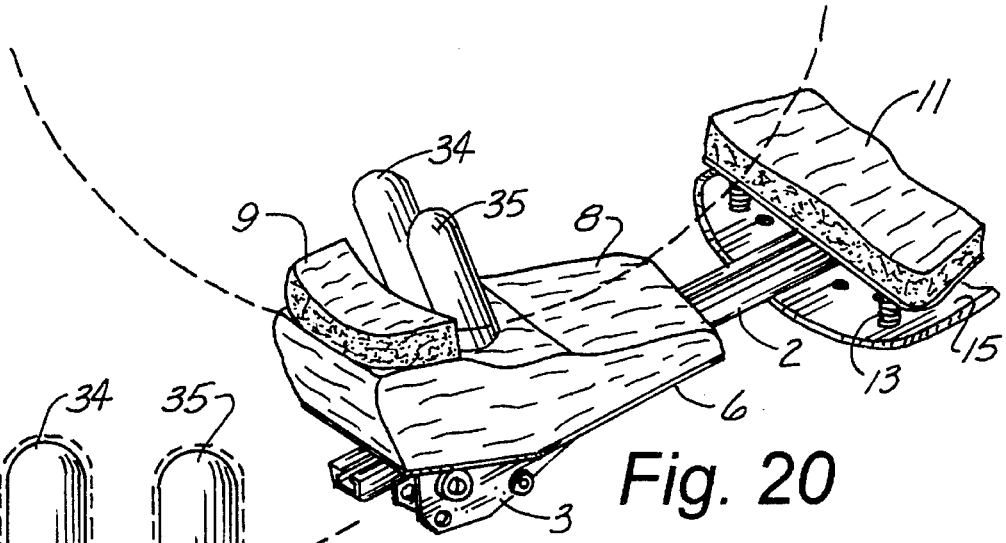
FIG. 20 is a side elevational view of the embodiment of the present invention shown in FIG. 19.
Figure 22:
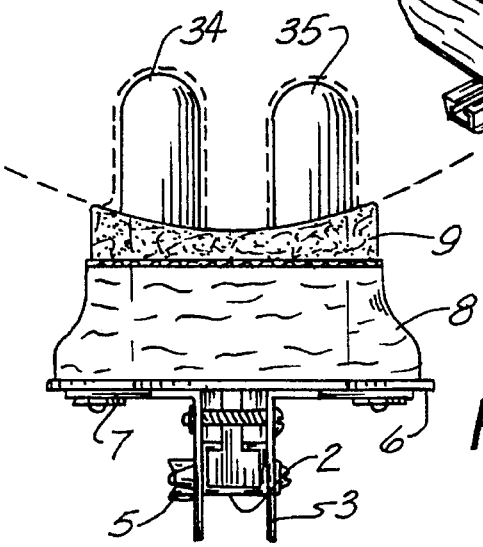
FIG. 22 is a cross-section of the embodiment of the present invention as depicted in FIG. 21.

In FIG. 13, the support apparatus of the present invention is positioned on the arm of a user in a manner which exposes the middle two fingers of the wearer and contacts the ball in a way to impart a desired degree of spin to the bowling ball.

In FIG. 14, the support apparatus of the present invention is positioned on the arm of a user so as to expose the index and second fingers and cover the pinky finger and ring finger, and contact the ball in a way so as to assist the bowler in imparting desired roll and spin to the ball.

Another embodiment of the present invention is shown in FIGS. 19–22, wherein artificial fingers 34 and 35 are provided and positioned through pad 8 in a manner so as to be inserted into holes of the bowling ball. This embodiment is particularly advantageous for use by individuals who fingers may not be sufficiently strong to be used for such purposes.

In this regard, often ligaments, tendons and joints of fingers of bowlers have become sensitive and otherwise tender over time as a result of stress and strain, or physical conditions such as arthritis, that would make gripping a bowling difficult if not painful. This embodiment of the present invention is particularly suitable for minimizing the difficulties caused by such conditions.

For purposes of the present invention, it is preferred that the shape of the apparatus is substantially in the shape of a "Y" so as to more closely conform to the shape of a hand.

The apparatus of the present invention is also advantageous in that it permits substantially no bend at the wrist. In accordance with the present invention, bending is preferably limited to the fingers for hand strength and ball control.

In accordance with the present invention, the apparatus provides support and stabilization to substantially the entire power area of the hand including the wrist, hand, and fingers.

The apparatus in accordance with the present invention is advantageous in that its component parts or elements may be adjusted to assist a bowler in delivering a ball that rolls substantially straight, or in imparting a hook or a delayed hook to the roll of the ball.

Although not wishing to be bound by any particular theory, the apparatus of the present invention is advantageous in that the ball is lifted not so much with the fingers but more with the stabilizer and pad area at the back end of the device so as to deliver the strength of the arm to the ball more through the pressure pad of the support apparatus.

The apparatus in accordance with the present invention is also advantageous in that the fingers which are held in the ball are not permitted to move and thereby the apparatus of the present invention minimizes or reduces the tendency of aberrant or undesired movement imparted by moving fingers to the bowling ball.

Although the present invention has been described in detail herein, it should be apparent that many substitutions, modifications and variations of the invention are possible in light of the above teachings. It is therefore to be understood that the invention as taught and described herein is only to be limited to the extent of the breadth and scope of the appended claims.

What is claimed is:

1. A bowling apparatus comprising:

a) a first support comprising a pad, said pad comprising a finger pad having opposed surfaces with one surface in contact with the first support and the other surface adapted to cover at least a portion of the back of at least one finger of a bowler, and a ball pad extending from said finger pad other surface and adapted to contact a bowling ball;

b) a second support adapted to cover at least a wrist of a hand of a bowler;

c) an adjustable support comprising one end connected to said first support and another end pivotally connected to said second support.

2. The bowling apparatus of claim 1, wherein said ball pad comprises a removable pad section adapted to contact a bowling ball.

3. The bowling apparatus of claim 2, wherein said second support comprises a pad portion adapted to contact the wrist of a bowler.

4. The bowling apparatus of claim 3, comprising at least one strap attached to said second support adapted to secure the second support to the hand of a bowler.

5. The bowling apparatus of claim 1, comprising a bracket fixed to said first support wherein said one end of said adjustable support is moveably fitted to said bracket.

6. The bowling apparatus of claim 5, wherein said second support comprises a plate having a plurality of position adjustment orifices adapted to receive a detent associated with said adjustable support to secure said adjustable support shaft in a predetermined position.

7. The bowling apparatus of claim 6, wherein said plurality of orifices comprise at least three orifices.

8. The bowling apparatus of claim 1, wherein said first support comprises, extending from said finger pad other surface, at least one artificial finger adapted to be inserted into holes of a bowling ball.

* * * * *